US011842706B2

(12) United States Patent
Ishii

(10) Patent No.: US 11,842,706 B2
(45) Date of Patent: Dec. 12, 2023

(54) SOURCE DRIVER FOR DISPLAY DEVICE DETECTING ABNORMALITY IN DATA RECEIVING

(71) Applicant: LAPIS Technology Co., Ltd., Yokohama (JP)

(72) Inventor: Hiroaki Ishii, Yokohama (JP)

(73) Assignee: LAPIS Technology Co., Ltd., Yokohama (JP)

( * ) Notice: Subject to any disclaimer, the term of this patent is extended or adjusted under 35 U.S.C. 154(b) by 0 days.

(21) Appl. No.: 17/693,391

(22) Filed: Mar. 13, 2022

(65) Prior Publication Data

US 2022/0310033 A1 Sep. 29, 2022

(30) Foreign Application Priority Data

Mar. 29, 2021 (JP) ..... 2021-055517

(51) Int. Cl.
*G09G 3/36* (2006.01)

(52) U.S. Cl.
CPC ..... *G09G 3/3696* (2013.01); *G09G 2310/08* (2013.01)

(58) Field of Classification Search
CPC ..... G09G 3/36; G09G 3/3611; G09G 3/3614; G09G 3/3622; G09G 3/3625; G09G 3/364; G09G 3/3648; G09G 3/3674; G09G 3/3677; G09G 3/3681; G09G 3/3685; G09G 3/3688; G09G 3/3692; G09G 3/3696
USPC ..... 345/87–104
See application file for complete search history.

(56) References Cited

U.S. PATENT DOCUMENTS

2006/0013291 A1* 1/2006 Hashimoto ..... H04L 25/0292 375/150
2006/0262065 A1* 11/2006 Luo ..... G09G 3/2096 345/98
2008/0007508 A1* 1/2008 Yoneyama ..... G09G 5/005 345/100
2009/0015519 A1* 1/2009 Hori ..... G09G 3/20 345/60
2009/0213063 A1* 8/2009 Shimura ..... G09G 3/342 345/102

(Continued)

FOREIGN PATENT DOCUMENTS

JP 2008096660 4/2008

*Primary Examiner* — Amit Chatly
*Assistant Examiner* — Nelson Lam
(74) *Attorney, Agent, or Firm* — JCIPRNET

(57) ABSTRACT

A source driver is provided, including a first data receiving part that receives a serial data signal via the first transmission line, a selector that outputs a serial data signal from either the first transmission line or the second transmission line according to a switching signal, a second data receiving part that receives the serial data signal output from the selector, a first serial-parallel conversion circuit that serial-parallel converts the serial data signal received by the first data receiving part and outputs the converted signal as first parallel data, a second serial-parallel conversion circuit that serial-parallel converts the serial data signal received by the second data receiving part and outputs the converted signal as second parallel data, and a comparison circuit that compares the first parallel data with the second parallel data and outputs a comparison result when the selector outputs the serial data signal from the first transmission line.

5 Claims, 7 Drawing Sheets

(56) References Cited

U.S. PATENT DOCUMENTS

| | | | | |
|---|---|---|---|---|
| 2009/0309869 | A1* | 12/2009 | Umeda | G09G 3/3688 345/87 |
| 2010/0201556 | A1* | 8/2010 | Azami | G09G 3/3614 341/144 |
| 2010/0225620 | A1* | 9/2010 | Lee | G09G 3/20 345/204 |
| 2010/0295841 | A1* | 11/2010 | Matsuda | G09G 3/3685 345/213 |
| 2010/0321413 | A1* | 12/2010 | Weng | G09G 3/3688 345/99 |
| 2011/0001765 | A1* | 1/2011 | Hyodo | G09G 3/3688 341/120 |
| 2013/0069717 | A1* | 3/2013 | Kim | G09G 3/3614 330/9 |
| 2013/0257847 | A1* | 10/2013 | Lee | G09G 3/3688 345/92 |
| 2020/0168175 | A1* | 5/2020 | Tsuchi | G09G 3/2096 |
| 2022/0114982 | A1* | 4/2022 | Tsuchi | G09G 3/3291 |

* cited by examiner

SOURCE DRIVER FOR DISPLAY DEVICE DETECTING ABNORMALITY IN DATA RECEIVING

CROSS-REFERENCE TO RELATED APPLICATION

This application claims priority under 35 USC 119 from Japanese Patent application No. 2021-055517 filed on Mar. 29, 2021, the disclosure of which is incorporated by reference herein.

BACKGROUND

Technical Field

The present disclosure relates to a source driver and a display device.

Related Art

An active matrix driving type is adopted as a driving type of a display device such as a liquid crystal display device or an organic electro luminescence (EL) display device. In the active matrix driving type display device, the display panel is composed of a semiconductor substrate in which pixel parts and pixel switches are arranged in a matrix. By controlling the on and off of the pixel switch by a gate signal from a gate driver and supplying a driving signal corresponding to a video data signal to the pixel part when the pixel switch is turned on, the luminance of each pixel part is controlled to perform display. For example, the source driver applies an analog voltage to the horizontal row of pixel parts selected by the gate driver to display the horizontal row, and repeats this in the vertical direction while changing the selected pixel row to display the screen of one frame.

When the source driver has 960 output signal lines, image data for 960 channels is serially transmitted from the timing controller to the source driver. The source driver receives the data serially transmitted from the timing controller, performs serial-parallel conversion, and stores the converted data in the data latch group. The stored parallel data is D/A converted by the DAC circuit and output as an analog gradation voltage signal.

In order to improve the communication speed of image data communication in a display device, a configuration having a plurality of data transmission lanes is known. In such a display device having a plurality of lanes, the number of operating lanes can be switched, and the non-operating lanes are generally set to stop the current supply to reduce the current consumption.

Incidentally, in recent years, the above-described display devices are often installed as important safety parts such as electronic mirrors or clusters in vehicles such as automobiles. In such an in-vehicle display device, it is necessary to promptly detect the failure of the device in order to avoid the system becoming dangerous due to the failure of the device. For example, in a display device having a liquid crystal panel, a display device including a monitoring circuit for monitoring at least one of a current value and a voltage value of a power supply line has been suggested in order to reliably give a failure warning of a display system including a power supply system (for example, Japanese Patent Application Laid-Open No. 2008-96660).

As a method of detecting a failure of a data receiving part of the source driver, a method of cyclic redundancy check (CRC) is used. However, in order to perform failure detection by cyclic redundancy check, the communication interface needs to support CRC. Therefore, there is a problem that failure detection may not be able to be performed depending on the type of interface. Further, there is a restriction that both the timing controller on the transmitting side and the data receiving part of the source driver on the receiving side must support CRC.

The disclosure provides a source driver capable of detecting an abnormality in a data receiving part with a simple configuration regardless of the configuration of the data transmitting side or the type of communication interface.

SUMMARY

According to an embodiment of the disclosure, there is provided a source driver that receives a serial data signal including a series of a plurality of pixel data pieces via a first transmission line and a second transmission line, and outputs a driving voltage for driving a plurality of pixel parts to a plurality of source lines of a display panel having the plurality of source lines and the plurality of pixel parts connected to the plurality of source lines based on the plurality of pixel data pieces, the source driver including: a first data receiving part that receives a serial data signal via the first transmission line; a selector that outputs a serial data signal from either the first transmission line or the second transmission line according to a switching signal; a second data receiving part that receives the serial data signal output from the selector; a first serial-parallel conversion circuit that serial-parallel converts the serial data signal received by the first data receiving part and outputs the converted signal as first parallel data; a second serial-parallel conversion circuit that serial-parallel converts the serial data signal received by the second data receiving part and outputs the converted signal as second parallel data; and a comparison circuit that compares the first parallel data with the second parallel data and outputs a comparison result when the selector outputs the serial data signal from the first transmission line.

In addition, according to an embodiment of the disclosure, there is provided a display device including: a display panel having a plurality of source lines and a plurality of gate lines, and a plurality of pixel parts provided in a matrix at each of intersection parts of the plurality of source lines and the plurality of gate lines; a timing controller that outputs a serial data signal including a series of a plurality of pixel data pieces; and a source driver that receives the serial data signal from the timing controller via a first transmission line and a second transmission line, and outputs a driving voltage for driving the plurality of pixel parts to the plurality of source lines based on the plurality of pixel data pieces, in which the source driver includes a first data receiving part that receives a serial data signal via the first transmission line, a selector that outputs a serial data signal from either the first transmission line or the second transmission line according to a switching signal, a second data receiving part that receives the serial data signal output from the selector, a first serial-parallel conversion circuit that serial-parallel converts the serial data signal received by the first data receiving part and outputs the converted signal as first parallel data, a second serial-parallel conversion circuit that serial-parallel converts the serial data signal received by the second data receiving part and outputs the converted signal as second parallel data, and a comparison circuit that compares the first parallel data with the second parallel data and outputs a comparison result when the selector outputs the serial data signal from the first transmission line.

DETAILED DESCRIPTION

Figure 1:
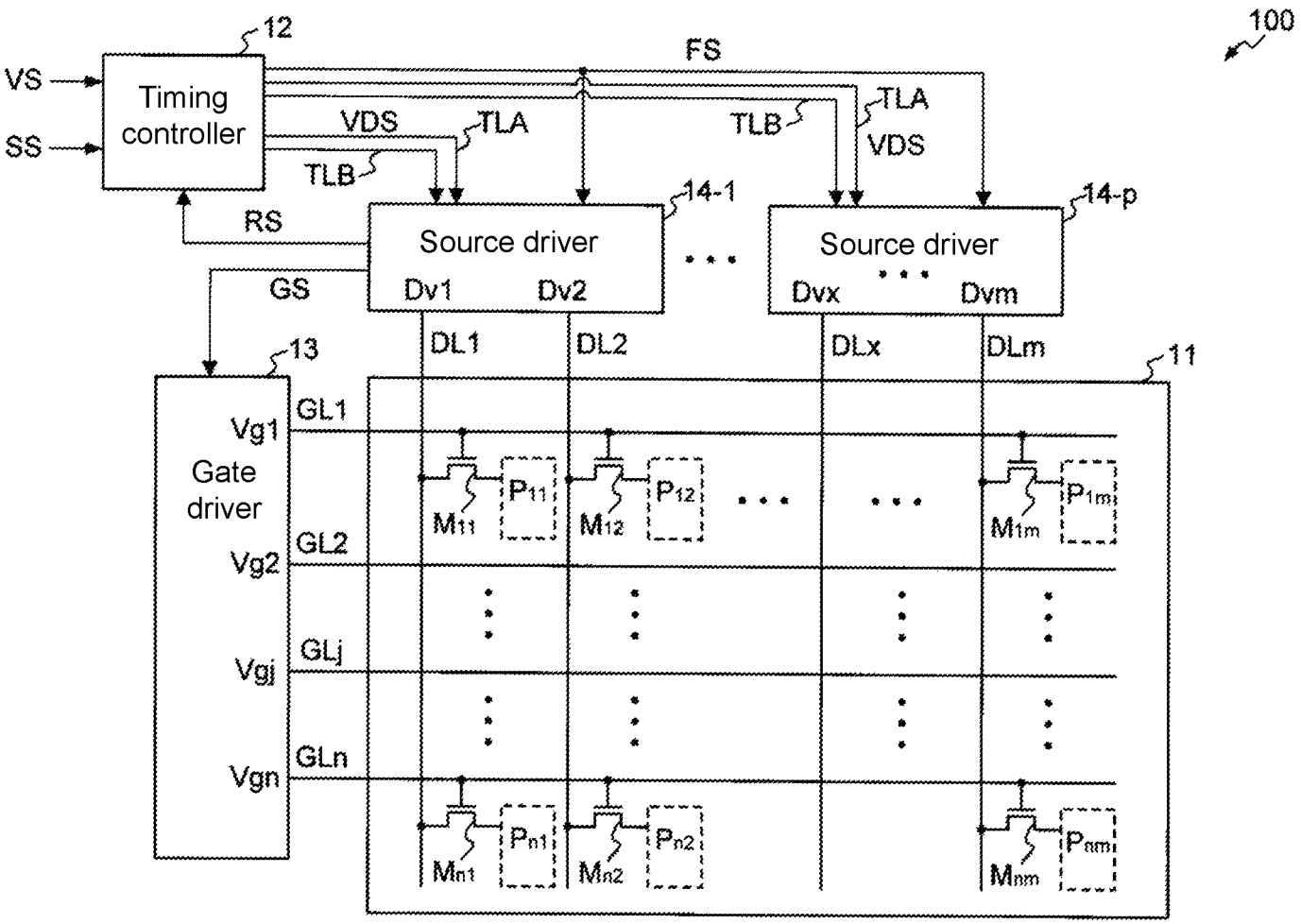
FIG. 1 is a block diagram illustrating a configuration of a display device according to the disclosure.

Hereinafter, exemplary examples of the disclosure will be described in detail. In the description and the attached drawings in each of the following examples, substantially the same or equivalent parts will be given the same reference numerals.

Example 1

FIG. 1 is a block diagram illustrating a configuration of a display device 100 according to the disclosure. The display device 100 is an active matrix driving type liquid crystal display device. The display device 100 includes a display panel 11, a timing controller 12, a gate driver 13, and source drivers 14-1 to **14-*p***.

The display panel 11 is composed of a semiconductor substrate in which a plurality of pixel parts $P_{11}$ to $P_{nm}$ and pixel switches $M_{11}$ to $M_{nm}$ (n, m: natural numbers of 2 or more) are arranged in a matrix. The display panel 11 has n gate lines GL1 to GLn, each of which is a scanning line extending in the horizontal direction, and m source lines DL1 to DLm arranged to intersect the gate lines GL1 to GLn. The pixel parts $P_{11}$ and $P_{nm}$ the pixel switches $M_{11}$ to $M_{nm}$ are provided at the intersection parts of the gate lines GL1 to GLn and the source lines DL1 to DLm.

The pixel switches $M_{11}$ to $M_{nm}$ controlled to be turned on or off according to gate signals Vg1 to Vgn supplied from the gate driver 13.

The pixel parts $P_{11}$ to $P_{nm}$ supplied with a driving voltage (gradation voltage) corresponding to video data from the source driver 14. Specifically, when the driving voltages Dv1 to Dvm are output from the source driver 14 to the source lines DL1 to DLm and each of the pixel switches $M_{11}$ to $M_{nm}$ is turned on, the driving voltages Dv1 to Dvm are applied to the pixel parts $P_{11}$ to $P_{nm}$. Accordingly, the pixel electrodes of each of the pixel parts $P_{11}$ to $P_{nm}$ are charged and the luminance is controlled.

When the display device 100 is a liquid crystal display device, each of the pixel parts $P_{11}$ to $P_{nm}$ includes a liquid crystal display enclosed between a transparent electrode connected to the source lines DL1 to DLm via the pixel switches $M_{11}$ to $M_{nm}$ and a counter substrate provided to face the semiconductor substrate and having one transparent electrode formed on the entire surface. Display is performed by changing the transmittance of the liquid crystal with respect to the backlight inside the display device according to the potential difference between the driving voltage (gradation voltage) applied to the pixel parts $P_{11}$ to $P_{nm}$ and the counter substrate voltage.

The timing controller 12 generates a series (serial signal) of pixel data pieces PD in which the luminance level of each pixel is represented by, for example, 256 levels of luminance gradation of 8 bits based on video data VS. Further, the timing controller 12 generates an embedded clock type clock signal CLK having a constant clock cycle based on a synchronization signal SS. The timing controller 12 generates a video data signal VDS which is a serial signal in which a series of pixel data pieces PD and a clock signal CLK are integrated, and supplies the generated video data signal VDS to the source drivers 14-1 to **14-*p*** to control the display of the video data. The video data signal VDS is configured as a video data signal serialized according to the number of transmission paths for each predetermined number of source lines.

In this example, n pixel data piece groups each composed of m pixel data pieces PD are serially continuous to form the video data signal VDS for one frame. Each of the n pixel data piece groups is a pixel data piece group composed of pixel data pieces corresponding to the gradation voltage for which the pixels on each one of the horizontal scanning lines (that is, each of the gate lines GL1 to GLn) are supplied. By the operation of the source drivers 14-1 to **14-*p*, the driving voltage signals Dv1** to Dvm, for which n×m pixel parts (that is, pixel parts $P_{11}$ to $P_{nm}$) are supplied, are applied via the source line based on the m×n pixel data pieces PD.

A first transmission path TLA and a second transmission path TLB, which are a pair of transmission paths for transmitting the video data signal VDS, are provided between the timing controller 12 and each of the source drivers 14-1 to **14-*p*. While the first transmission path TLA is always used for data transmission, the second transmission path TLB is configured to be switchable whether or not to be used for data transmission according to the selection of the timing controller 12**. When data transmission is performed using both the first transmission path TLA and the second transmission path TLB, the communication rate of data communication is higher than that when data transmission is performed using only the first transmission path TLA.

Further, the timing controller 12 generates a frame synchronization signal FS indicating the timing of each frame of the video data signal VDS based on the synchronization signal SS, and supplies the generated signal to the source drivers 14-1 to **14-*p***.

Further, the timing controller 12 receives a comparison result signal RS from each of the source drivers 14-1 to **14-*p*. The comparison result signal RS is a signal indicating the processing result of the data comparison processing (which will be described later) performed inside each source driver. The timing controller 12** has an abnormality detecting part (not illustrated) that detects whether or not there is an abnormality in the receiving part and the data processing part in the source driver based on the comparison result signal RS.

The gate driver 13 receives a gate control signal GS supplied from the source driver 14-1, and sequentially supplies the gate signals Vg1 to Vgn to the gate lines GL1 to GLn based on the clock timing included in the gate control signal GS. By supplying the gate signals Vg1 to Vgn, the pixel parts $P_{11}$ to $P_{nm}$ are selected for each pixel row. Then, by applying the driving voltage signals Dv1 to Dvm from the source drivers 14-1 to **14-*p*** to the selected pixel part, the gradation voltage is written to the pixel electrode.

In other words, by the operation of the gate driver 13, m pixel parts arranged in the extension direction of the gate line (that is, in a horizontal row) are selected as supply targets of the driving voltage signals Dv1 to Dvm. The source driver 14 applies the driving voltage signals Dv1 to Dvm to the selected horizontal row of pixel parts, and displays colors according to the voltage. The screen display for one frame is performed by repeating the display in the extension direction (that is, the vertical direction) of the data line while selectively switching one horizontal row of pixel parts selected as the supply targets of the driving voltage signals Dv1 to Dvm.

The pixel parts $P_{11}$ to $P_{nm}$ correspond to three pixels such as R (red), G (green), and B (blue) for each of three adjacent pixel parts (that is, 3 channels of pixel parts) out of m pixel parts arranged in the extension direction of the gate line. In other words, when j=(⅓)m, the first channel, the fourth channel, . . . , and the (3j−2)th channel correspond to "R," the second channel, the fifth channel, . . . , and the (3j−1)th channel correspond to "G," and the third channel, the sixth channel, . . . , and the (3j)th channel correspond to "B." For example, one color is expressed by a combination of R, G, and B of the first channel, the second channel, and the third channel.

The source drivers 14-1 to **14-*p* are provided for each of a predetermined number of source lines obtained by dividing the source lines DL1 to DLm. The number of source lines driven by each source driver corresponds to the number of output channels of the source driver. For example, when one source driver has an output of 960 channels and the display panel has one source line per pixel row, the source line is driven by 12 source lines for the 4K panel and 24 source lines for the 8K panel. In this example, assuming a case where each of the source drivers 14-1 to 14-*p*** drives k (k is an integer of 2 or more and less than m) source lines (that is, a case where the number of output channels is k) as an example, the following description will be given.

Each of the source drivers 14-1 to **14-*p* receives the frame synchronization signal FS and the video data signal VDS supplied from the timing controller 12 via each of different transmission paths. The source drivers 14-1 to 14-*p* apply the driving voltages Dv1 to Dvm corresponding to the multi-valued level gradation voltage corresponding to the number of gradations shown in the video data signal VDS, to the pixel parts $P_{11}$ to $P_{nm}$ via the source lines DL1 to DLm. In addition, the number of source lines DL1 to DLm (that is, m lines) corresponds to the total number of output channels of the source drivers 14-1 to 14-*p***.

Figure 2:
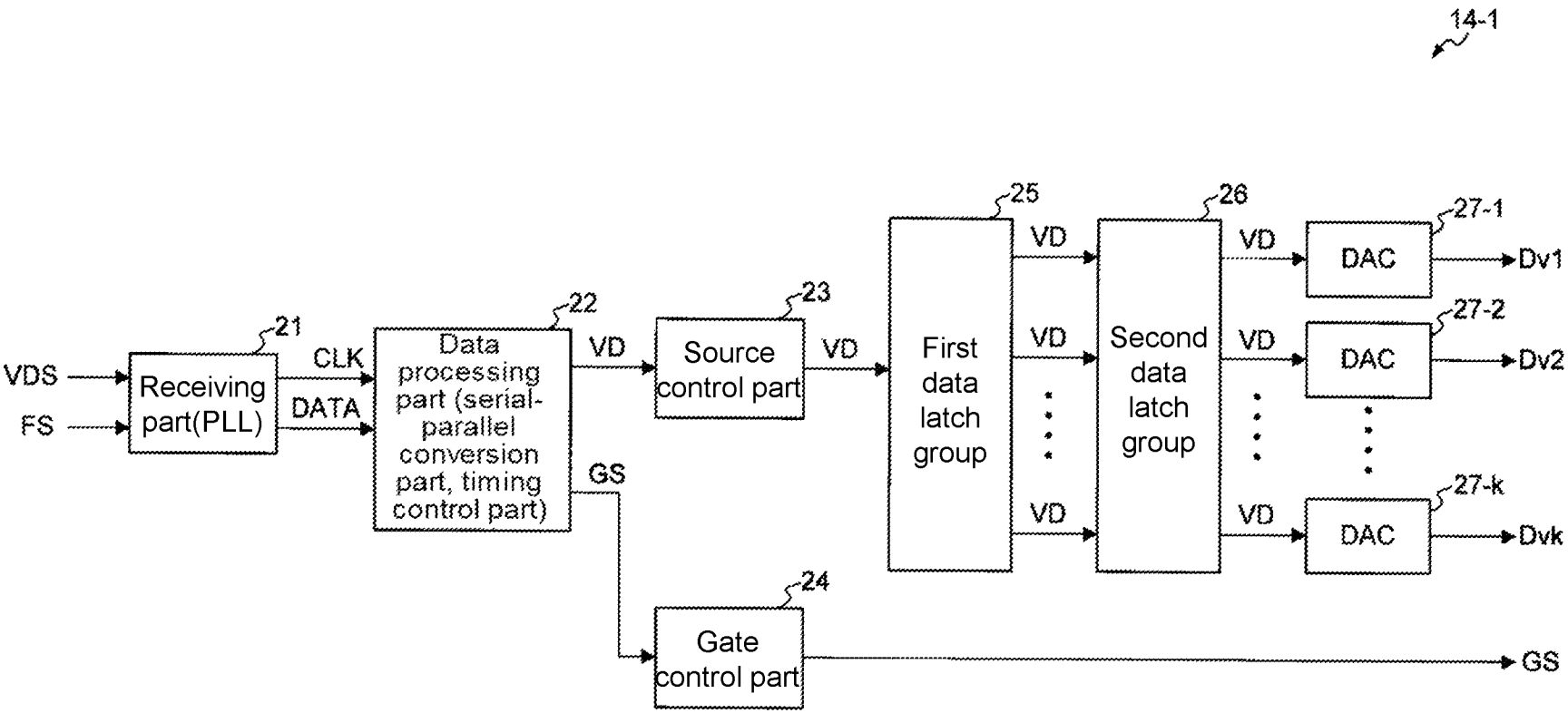
FIG. 2 is a block diagram illustrating a configuration of a source driver according to the disclosure.

FIG. 2 is a block diagram illustrating an internal configuration of the source driver 14-1. The source driver 14-1 is composed of a receiving part 21, a data processing part 22, a source control part 23, a gate control part 24, a first data latch group 25, a second data latch group 26, and DACs 27-1 to **27-*k*. The source drivers 14-2 to 14-*p* other than the source driver 14-1 also have the same configuration as that in FIG. 2 except for the gate control part 24. In the following description, when the configuration common to the source drivers 14-1 to 14-*p* is described, the source driver having the configuration is also simply referred to as the source driver 14**.

The receiving part 21 is an interface circuit part that receives the video data signal VDS and the frame synchronization signal FS from the timing controller 12. The receiving part 21 includes a phase locked loop (PLL) circuit. The receiving part 21 supplies a series of pixel data pieces PD (indicated as "DATA" in FIG. 2) included in the received video data signal VDS to the data processing part 22. Further, the receiving part 21 extracts the clock signal CLK from the video data signal VDS and supplies the extracted clock signal CLK to the data processing part 22.

The receiving part 21 of this example is composed of two lanes (not shown in FIG. 2), each of which receives the video data signal VDS and the frame synchronization signal FS from the timing controller 12. A description of these two lanes will be described later.

The data processing part 22 includes a serial-parallel conversion part, converts a series (DATA) of pixel data pieces PD supplied from the receiving part 21 into image data VD as parallel data, and supplies the converted data to the source control part 23.

Further, the data processing part 22 includes a timing control part (not illustrated), generates a horizontal synchronization signal LS according to the input of a series of pixel data pieces PD for one horizontal period, and supplies the generated signal to the second data latch group 26. In addition, the timing control part of the data processing part 22 generates the gate timing signal GS that controls the operation timing of the gate driver and supplies the generated signal to the gate control part 24.

The source control part 23 sequentially stores the image data VD serial-parallel converted by the data processing part 22 in the first data latch group 25 according to a predetermined data mapping.

The gate control part 24 outputs the gate timing signal GS, and controls the output timing of the gate signals Vg1 to Vgn by the gate driver 13.

The first data latch group 25 is composed of k data latches corresponding to the source lines DL1 to DLk. Each of the k data latches that configure the first data latch group 25 sequentially outputs the captured image data VD.

Similar to the first data latch group 25, the second data latch group 26 is composed of k data latches corresponding to the source lines DL1 to DLk. The second data latch group 26 uses the horizontal synchronization signal LS as a latch clock, and captures the image data VD output from the first data latch group 25 at the rise of the signal. The second data latch group 26 sequentially outputs the captured image data VD and supplies the output data to the DACs 27-1 to **27-*k***.

The digital analog converters (DACs) 27-1 to **27-*k* perform level shift and analog conversion on the image data VD output from the second data latch group 26, and generate the driving voltage signals Dv1** to DVk.

Figure 3:
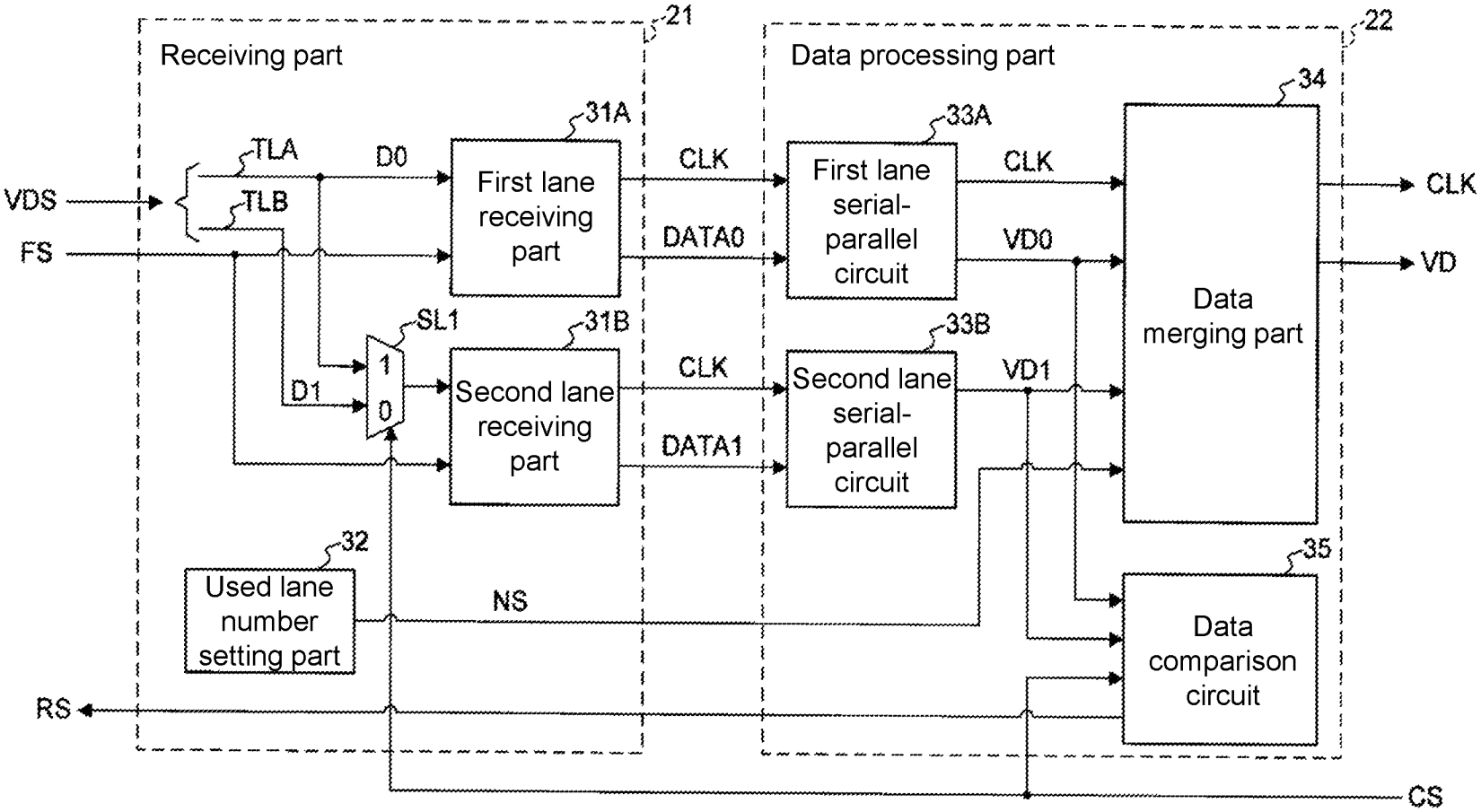
FIG. 3 is a block diagram illustrating a configuration of a data receiving part according to Example 1.

FIG. 3 is a block diagram illustrating a detailed configuration of the receiving part 21 and the data processing part 22. In addition, the timing control part included in the data processing part 22 is omitted in the drawing.

The receiving part 21 is connected to the timing controller 12 via the first transmission path TLA and the second transmission path TLB. In the following description, the image data included in the video data signal VDS transmitted via the first transmission path TLA is referred to as pixel data D0, and the image data included in the video data signal VDS transmitted via the second transmission path TLB is referred to as pixel data D1. For example, when the timing controller 12 transmits data using both the first transmission path TLA and the second transmission path TLB, the pixel data D0 and the pixel data D1 configure the serial data (pixel data piece PD) for one horizontal scanning line. Meanwhile, when the timing controller 12 transmits data using only the first transmission path TLA, the pixel data D0 configures the serial data (pixel data piece PD) for one horizontal scanning line.

The receiving part 21 has a first lane receiving part 31A and a second lane receiving part 31B. The first lane receiving part 31A is connected to the first transmission path TLA. The first lane receiving part 31A receives the video data signal VDS transmitted from the timing controller 12 via the first transmission path TLA. Further, the first lane receiving part 31A receives the frame synchronization signal FS from the timing controller 12, and extracts (generates) and outputs serial data DATA0 and the clock signal CLK based on the received video data signal VDS and the frame synchronization signal FS.

The second lane receiving part 31B receives the video data signal VDS transmitted from the timing controller 12 via either the first transmission path TLA or the second transmission path TLB. In this example, a selector SL1 is provided in front of the input part of the second lane receiving part 31B, and the second lane receiving part 31B is selectively connected to any one of the first transmission path TLA and the second transmission path TLB by the switching operation of the selector SL1.

In other words, the selector SL1 outputs the video data signal VDS from either the first transmission path TLA or the second transmission path TLB according to a comparison control signal CS which is a switching signal. The second lane receiving part 31B receives the video data signal VDS output from the selector SL1. The comparison control signal CS is supplied from a comparison control circuit (not illustrated) provided inside the source driver 14-1.

Further, the second lane receiving part 31B receives the frame synchronization signal FS from the timing controller 12, and extracts (generates) and outputs serial data DATA1 and the clock signal CLK based on the received video data signal VDS and the frame synchronization signal FS.

Further, the receiving part 21 has a used lane number setting part 32. The used lane number setting part 32 generates a used lane number setting signal NS based on information on the number of transmission paths used by the timing controller 12 for data transmission (that is, whether the data is transmitted using only the first transmission path TLA or both of the first transmission path TLA and the second transmission path TLB), and supplies the generated signal to a data merging part 34 of the data processing part 22. The used lane number setting signal NS is an enable signal of the second lane, and when the second lane is used, the logic level is 1 (H level), and the number of used lanes is set to "2". Meanwhile, when the second lane is not used, the logic level of the used lane number setting signal NS becomes 0 (L level), and the number of used lanes is set to "1".

The data processing part 22 includes a first lane serial-parallel circuit 33A, a second lane serial-parallel circuit 33B, the data merging part 34, and a data comparison circuit 35.

The first lane serial-parallel circuit 33A and the second lane serial-parallel circuit 33B are provided corresponding to the first lane receiving part 31A and the second lane receiving part 31B, respectively. The first lane serial-parallel circuit 33A converts the serial data DATA0 output from the first lane receiving part 31A into parallel data VD0, and supplies the converted data to the data merging part 34. The second lane serial-parallel circuit 33B converts the serial data DATA1 output from the second lane receiving part 31B into parallel data VD1, and supplies the converted data to the data merging part 34.

The data merging part 34 performs data merging of the parallel data VD0 supplied from the first lane serial-parallel circuit 33A and the parallel data VD1 supplied from the second lane serial-parallel circuit 33B, and generates the image data VD.

The data comparison circuit 35 compares the parallel data VD0 output from the first lane serial-parallel circuit 33A with the parallel data VD1 output from the second lane serial-parallel circuit 33B, and outputs the comparison result signal RS showing the comparison result. The data comparison circuit 35 receives the supply of the comparison control signal CS, and compares the parallel data VD0 with the parallel data VD1 only when the logic level of the signal level of the comparison control signal CS is 1 (H level).

The comparison result signal RS output from the data comparison circuit 35 is supplied to the timing controller 12. When the logic level of the comparison result signal RS is 1 (H level), the abnormality detecting part (not illustrated) of the timing controller 12 determines that there is no abnormality in any of the first lane receiving part 31A, the second lane receiving part 31B, the first lane serial-parallel circuit 33A, and the second lane serial-parallel circuit 33B. Meanwhile, when the logic level of the comparison result signal RS is 0 (L level), it is determined that there is an abnormality in any of the first lane receiving part 31A, the second lane receiving part 31B, the first lane serial-parallel circuit 33A, and the second lane serial-parallel circuit 33B.

An abnormality detecting part may be provided in the source driver 14, and for example, an abnormality may be determined in the source driver 14 by receiving the comparison result signal RS from the data comparison circuit 35.

Next, the comparison operation by the data comparison circuit 35 will be described with reference to FIG. 4. Here, a case where both the first transmission path TLA and the second transmission path TLB are used for data transmission, that is, a case where the number of used lanes is 2, will be described as an example.

Figure 4:
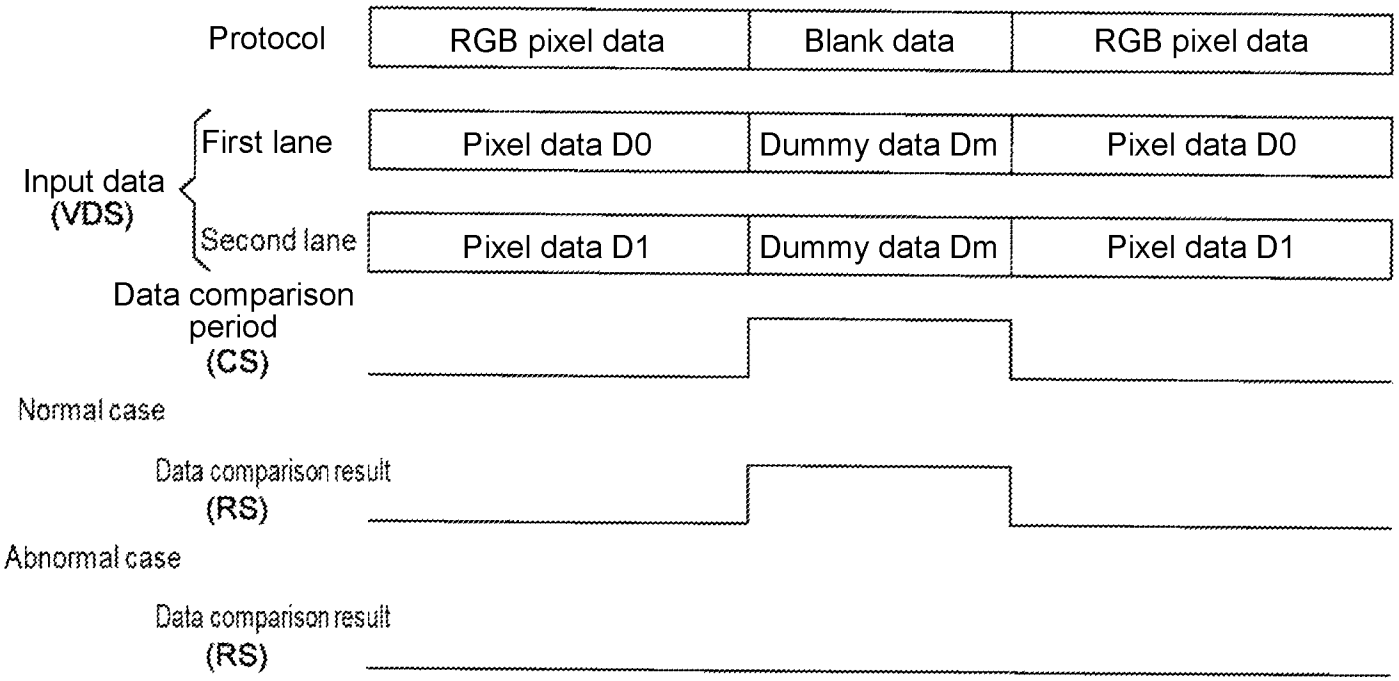
FIG. 4 is a diagram illustrating an example of input data and data comparison in each lane of Example 1.

The uppermost part of FIG. 4 shows the data format (protocol) of the video data signal VDS transmitted from the timing controller 12 to the source driver 14 in a simplified manner.

The video data signal VDS is composed of data parts for storing RGB pixel data for each horizontal scanning line and a blank data part provided therebetween.

When the number of used lanes is 2, the pixel data DO is supplied to the first lane receiving part 31A. Further, the pixel data D1 is supplied to the second lane receiving part 31B. In addition, in the video data signal VDS of this example, dummy data Dm is stored in the blank data part.

The comparison control signal CS reaches an L level during the supply period of RGB pixel data and an H level during the supply period of the dummy data Dm. Accordingly, the supply period of the dummy data Dm becomes the data comparison period.

During the RGB pixel data supply period in which the comparison control signal CS is at the L level, the selector SL1 illustrated in FIG. 3 is switched to "0", and the pixel data D1 is supplied to the second lane receiving part 31B. The first lane receiving part 31A generates the serial data DATA0 based on the pixel data D0, and the second lane receiving part 31B generates the serial data DATA1 based on the pixel data D1.

The first lane serial-parallel circuit 33A serial-parallel converts the serial data DATA0 and generates the parallel data VD0 corresponding to pixel data D0. The second lane serial-parallel circuit 33B serial-parallel converts the serial data DATA1 and generates the parallel data VD1 corresponding to pixel data D1. The data merging part 33 performs data merging of the parallel data VD0 and VD1 to generate the image data VD.

Meanwhile, during the data comparison period in which the comparison control signal CS is at the H level, the selector SL1 is switched to "1", and the same data as that of the first lane receiving part 31A is supplied to the second lane receiving part 31B. In other words, since the data comparison period is the supply period of the dummy data Dm, the same dummy data Dm is supplied to the first lane receiving part 31A and the second lane receiving part 31B.

The first lane receiving part 31A generates the serial data DATA0 based on the dummy data Dm. The first lane serial-parallel circuit 33A serial-parallel converts the serial data DATA0 and generates the parallel data VD0 corresponding to the dummy data Dm.

The second lane receiving part 31B generates the serial data DATA1 based on the dummy data Dm. The second lane serial-parallel circuit 33B serial-parallel converts the serial data DATA1 and generates the parallel data VD1 corresponding to the dummy data Dm.

The data comparison circuit 35 compares the parallel data VD0 and the parallel data VD1 generated during the data comparison period, and outputs the comparison result signal RS having an H level when both the parallel data VD0 and the parallel data VD1 match each other and an L level when the parallel data VD0 and the parallel data VD1 do not match each other.

As described above, since the first lane receiving part 31A and the second lane receiving part 31B have the same configuration, when the same data is input, the output data will be the same unless an abnormality such as a failure occurs. Since the same dummy data Dm is input to the first lane receiving part 31A and the second lane receiving part 31B during the data comparison period, when no abnormality has occurred in any of the first lane receiving part 31A and the second lane receiving part 31B, the serial data DATA0 output by the first lane receiving part 31A and the serial data DATA0 output by the second lane receiving part 31B are the same data.

Since the first lane serial-parallel circuit 33A and the second lane serial-parallel circuit 33B have the same configuration, when the same data is input, the output data will be the same unless an abnormality such as a failure occurs. When the serial data DATA0 and the serial data DATA0 are the same data, assuming that no abnormality has occurred in any of the first lane serial-parallel circuit 33A and the second lane serial-parallel circuit 33B, the parallel data VD0 obtained by serial-parallel converting the serial data DATA0 by the first lane serial-parallel circuit 33A and the parallel data VD0 obtained by serial-parallel converting the serial data DATA0 by the first lane serial-parallel circuit 33A are the same data.

Therefore, when the first lane receiving part 31A, the second lane receiving part 31B, the first lane serial-parallel circuit 33A, and the second lane serial-parallel circuit 33B are all normal (that is, no abnormality has occurred), the data comparison circuit 35 determines that the parallel data VD0 and the parallel data VD1 match each other, and the signal level of the comparison result signal RS reaches the H level.

On the other hand, when there is an abnormality in any of the first lane receiving part 31A, the second lane receiving part 31B, the first lane serial-parallel circuit 33A, and the second lane serial-parallel circuit 33B, the parallel data VD0 output from the first lane serial-parallel circuit 33A and the parallel data VD1 output from the second lane serial-parallel circuit 33B are data different from each other. Therefore, the data comparison circuit 35 determines that the parallel data VD0 and the parallel data VD1 do not match each other, and the signal level of the comparison result signal RS reaches the L level.

As described above, the display device 100 of this example utilizes a blank period (blank data part) of the video data signal VDS to supply the same dummy data Dm to the receiving parts and the serial-parallel conversion circuits of each of the first lane and the second lane, and determines whether or not both output data match each other by comparing the output data to detect the presence or absence of an abnormality in the receiving parts and the serial-parallel conversion circuits. In this example, since it is not necessary to receive the data used for the actual image display in the blank period in which the dummy data Dm is transmitted, the blank period is set as the data comparison period.

According to this configuration, unlike the case where failure detection is performed using cyclic redundancy check (CRC) or the like, without requiring special support (for example, communication interface, functional block, or the like that supports CRC) on the timing controller 12 side, it is possible to detect the presence or absence of an abnormality in the data receiving part and the serial-parallel conversion circuit using only the configuration on the source driver side.

Further, in this example, the blank period in which the dummy data Dm is transmitted is set as the data comparison period. Therefore, at the timing of transmitting the image data used for the actual image display, it is possible to perform data communication at a high communication rate and periodically perform data comparison using the blank period.

Example 2

Next, Example 2 of the disclosure will be described. The display device of Example 2 is different from the display device 100 of Example 1 in the configuration and operation of the selector in the source driver.

Figure 5:
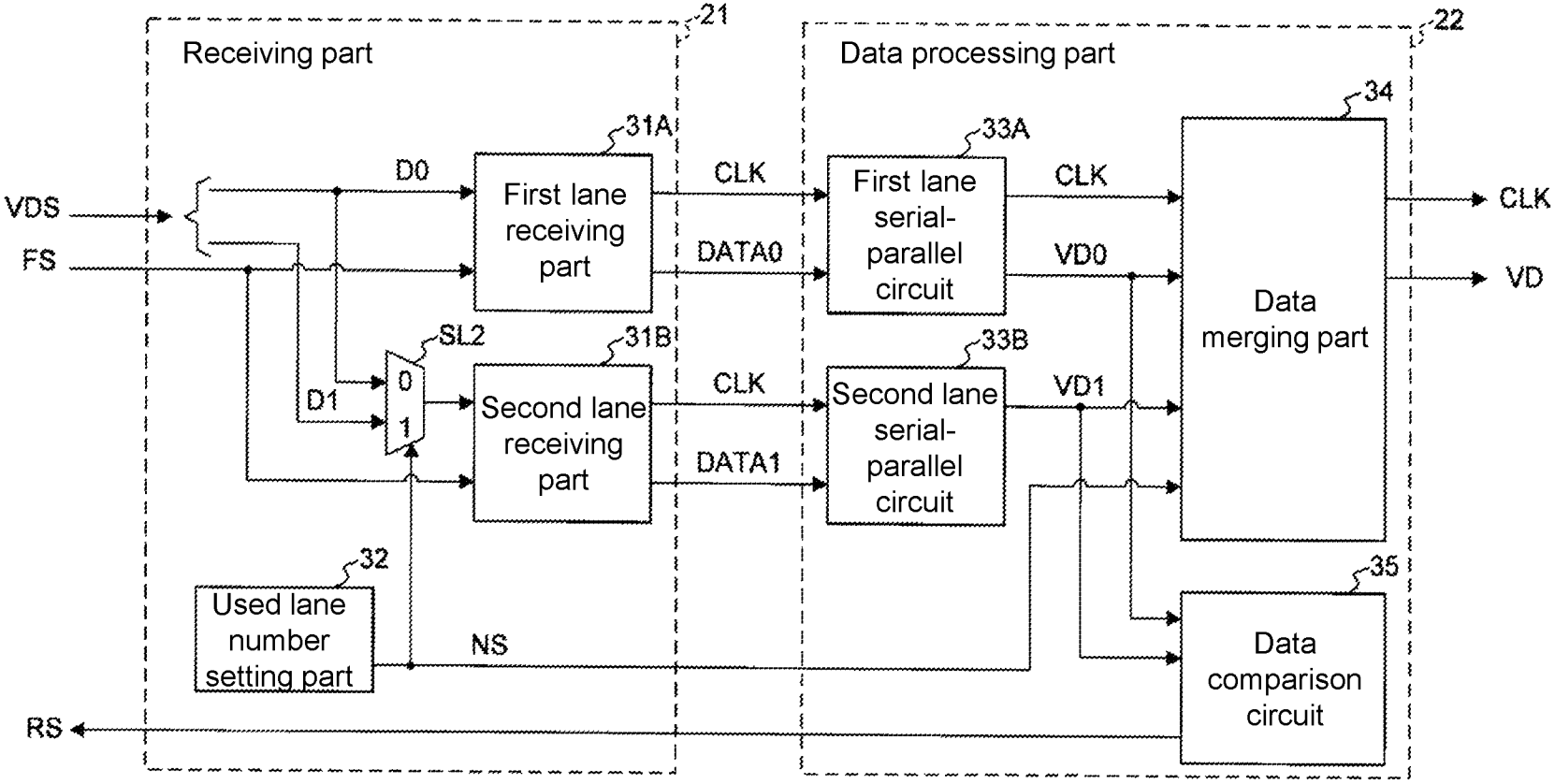
FIG. 5 is a block diagram illustrating a configuration of a data receiving part according to Example 2.

FIG. 5 is a block diagram illustrating a detailed configuration of the receiving part 21 and the data processing part 22 of this example.

A selector SL2 switches the connection destination of the input part of the second lane receiving part 31B based on the used lane number setting signal NS output from the used lane number setting part 32. Specifically, the selector SL2 performs switching for setting the connection destination to the first transmission path TLA when the logic level of the signal level of the used lane number setting signal NS is 0, and setting the connection destination to the second transmission path TLB when the logic level is 1.

Figure 6:
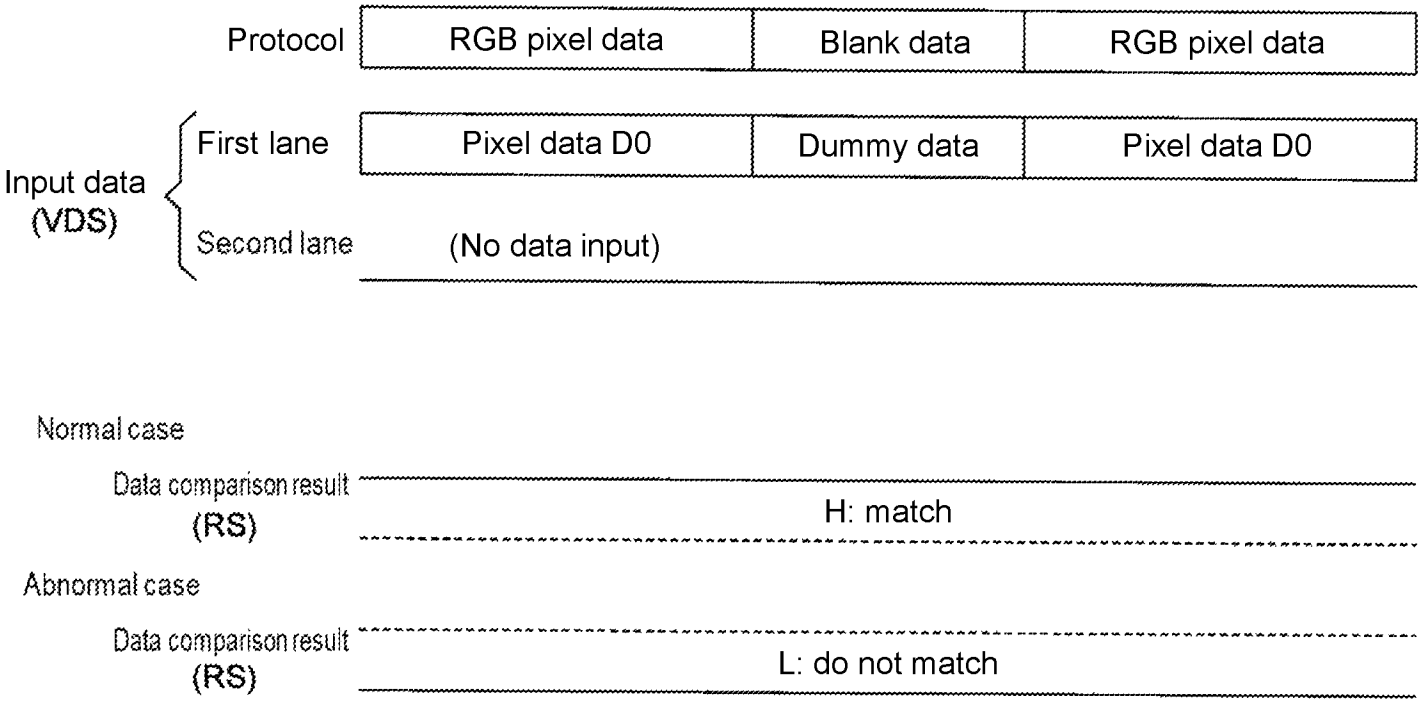
FIG. 6 is a diagram illustrating an example of input data and data comparison in each lane of Example 2.

Next, the comparison operation by the data comparison circuit 35 of this example will be described with reference to FIG. 6.

The data comparison circuit 35 of this example performs data comparison when the used lane number setting signal NS is at the L level, that is, when the number of used lanes is 1. When the number of used lanes is 1, while the video data signal VDS (pixel data D0) is transmitted from the timing controller 12 via the first transmission path TLA, the video data signal VDS is not transmitted to the second transmission path TLB.

Since the lane number setting signal NS is at the L level, the selector SL2 is switched to "0", and the same pixel data D0 is supplied to the first lane receiving part 31A and the second lane receiving part 31B.

The first lane receiving part 31A generates the serial data DATA0 based on the pixel data D0. The first lane serial-parallel circuit 33A serial-parallel converts the serial data DATA0 and generates the parallel data VD0 corresponding to pixel data D0.

The second lane receiving part 31B generates the serial data DATA1 based on the pixel data D0. The second lane serial-parallel circuit 33B serial-parallel converts the serial data DATA1 and generates the parallel data VD1 corresponding to pixel data D0.

The data comparison circuit 35 compares the parallel data VD0 and the parallel data VD1, and outputs the comparison result signal RS having an H level when both the parallel data VD0 and the parallel data VD1 match each other and an L level when the parallel data VD0 and the parallel data VD1 do not match each other.

In this example, the common dummy data Dm is supplied to the first lane receiving part 31A and the second lane receiving part 31B even during the blank period, and the same processing as that of the pixel data D0 is performed.

Therefore, in this example, the data comparison is performed during the entire period, and when the first lane receiving part 31A, the second lane receiving part 31B, the first lane serial-parallel circuit 33A, and the second lane serial-parallel circuit 33B are all normal (that is, no abnormality has occurred), the data comparison circuit 35 determines that the parallel data VD0 and the parallel data VD1 match each other, and the H level comparison result signal RS is output during the entire period.

As described above, in the source driver 14 of this example, when the number of used lanes is set to "1" by the used lane number setting signal NS, data comparison is always performed, and the presence or absence of an abnormality in the first lane receiving part 31A, the second lane receiving part 31B, the first lane serial-parallel circuit 33A, and the second lane serial-parallel circuit 33B is detected.

According to this configuration, similar to the case of Example 1, without requiring special support (for example, communication interface, functional block, or the like that supports CRC) on the timing controller 12 side, it is possible to detect the presence or absence of an abnormality in the data receiving part and the serial-parallel conversion circuit using only the configuration on the source driver side.

Further, unlike Example 1 in which data comparison is performed only during the data comparison period, the presence or absence of an abnormality can be constantly monitored.

The disclosure is not limited to the above-described embodiment. For example, in the above-described examples, a case where the receiving part and the data processing part of the source driver are composed of two communication lanes, such as the first lane and the second lane, has been described as an example. However, the number of communication lanes is not limited thereto, and may be composed of a plurality (3 or more) of communication lanes.

Further, in each of the above-described examples, a case where the selectors (SL1 and SL2) are arranged on the input side of the second lane receiving part 31B has been described as an example, but the selectors may be arranged at other positions. For example, in addition to the selector on the input side of the second lane receiving part 31B, a dummy selector that does not switch the connection of the transmission path may be disposed on the input side of the first lane receiving part 31A. According to such a configuration, the load capacity of the input part of the first lane receiving part 31A and the load capacity of the input part of the second lane receiving part 31B can be made uniform, and thus, it becomes easy to design the system.

Further, a selector may be provided on the output side instead of the input side of the second lane receiving part 31B, that is, between the second lane receiving part 31B and the second lane serial-parallel circuit 33B.

Figure 7:
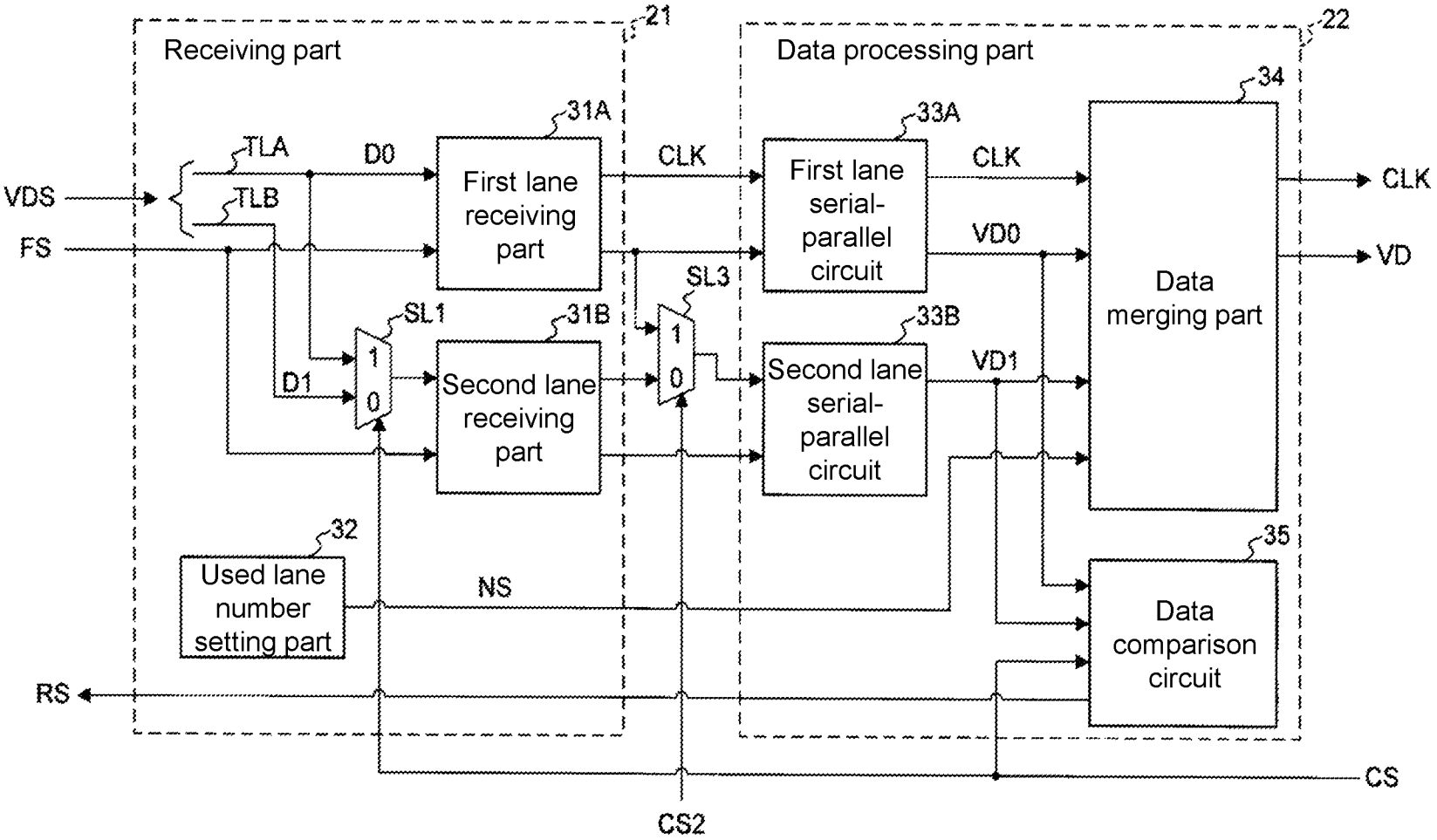
FIG. 7 is a block diagram illustrating a modification example of a configuration of the data receiving part.

FIG. 7 is a block diagram illustrating a configuration of a modification example of the data receiving part and the serial-parallel conversion circuit having such a configuration. A selector SL3 is provided on the input side of the second lane serial-parallel circuit 33B. The selector SL3 switches the connection destination of the input part of the second lane serial-parallel circuit 33B according to the signal level of a comparison control signal CS2. For example, the selector SL3 performs switching such that the first lane receiving part 31A is the connection destination when the logic level of the signal level of the comparison control signal CS2 is 1 (H level) and the second lane receiving part 31B is the connection destination when the logic level is 0 (L level).

According to such a configuration, for example, when it is determined that there is an abnormality in any of the first lane receiving part 31A, the second lane receiving part 31B, the first lane serial-parallel circuit 33A, and the second lane serial-parallel circuit 33B by comparing the data of Example 1, by connecting the second lane serial-parallel circuit 33B and the first lane receiving part 31A with each other and further performing the data comparison, it is possible to determine whether the abnormal part is on the receiving part side (the first lane receiving part 31A and the second lane receiving part 31B) or the serial-parallel circuit side (the first lane serial-parallel circuit 33A and the second lane serial-parallel circuit 33B).

Further, unlike each of the above-described examples and modification examples, a data comparison circuit may be provided after the data merging part 34. For example, by once decomposing the data after merging the data and comparing the decomposed data, it also becomes possible to detect the presence or absence of an abnormality in the data merging part.

Further, in the above-described examples, the configuration in which the source driver 14-1 generates the gate control signal GS for controlling the gate timing of the gate driver 13 and supplies the generated signal to the gate driver 13 has been described as an example. However, unlike this, the timing controller 12 may supply the gate control signal GS to the gate driver 13.

What is claimed is:

1. A source driver that receives a serial data signal including a series of a plurality of pixel data pieces via a first transmission line and a second transmission line, and outputs a driving voltage for driving a plurality of pixel parts to a plurality of source lines of a display panel having the plurality of source lines and the plurality of pixel parts connected to the plurality of source lines based on the plurality of pixel data pieces, the source driver comprising:

a first data receiving circuit that receives a serial data signal via the first transmission line;

a selector that outputs a serial data signal from either the first transmission line or the second transmission line according to a switching signal;

a second data receiving circuit that receives the serial data signal output from the selector;

a first serial-parallel conversion circuit that serial-parallel converts the serial data signal received by the first data receiving circuit and outputs a converted signal as first parallel data;

a second serial-parallel conversion circuit that serial-parallel converts the serial data signal received by the second data receiving circuit and outputs a converted signal as second parallel data; and a comparison circuit that compares the first parallel data with the second parallel data and outputs a comparison result when the selector outputs the serial data signal from the first transmission line, wherein the comparison result indicates whether an abnormality has occurred in any of the first data receiving circuit, the second data receiving circuit, the first serial-parallel conversion circuit, and the second serial-parallel conversion circuit of the source driver.

2. The source driver according to claim 1, wherein the serial data signal includes serial image data composed of a series of a plurality of pixel data pieces and dummy data transmitted following the image data, and the selector outputs the serial data signal from the first transmission line at a timing at which the dummy data is transmitted.

3. The source driver according to claim 1, wherein the serial data signal is received from a timing controller connected via the first transmission line and the second transmission line, the switching signal is a used lane number setting signal that sets a number of lanes used by the source driver to receive the serial data signal from the timing controller, and the selector outputs a serial data signal from the first transmission line when the number of lanes set by the used lane number setting signal is 1.

4. A display device comprising:

a display panel having a plurality of source lines and a plurality of gate lines, and a plurality of pixel parts provided in a matrix at each of intersection parts of the plurality of source lines and the plurality of gate lines;

a timing controller that outputs a serial data signal including a series of a plurality of pixel data pieces; and a source driver that receives the serial data signal from the timing controller via a first transmission line and a second transmission line, and outputs a driving voltage for driving the plurality of pixel parts to the plurality of source lines based on the plurality of pixel data pieces, wherein the source driver includes a first data receiving circuit that receives a serial data signal via the first transmission line, a selector that outputs a serial data signal from either the first transmission line or the second transmission line according to a switching signal, a second data receiving circuit that receives the serial data signal output from the selector, a first serial-parallel conversion circuit that serial-parallel converts the serial data signal received by the first data receiving circuit and outputs a converted signal as first parallel data, a second serial-parallel conversion circuit that serial-parallel converts the serial data signal received by the second data receiving circuit and outputs a converted signal as second parallel data, and a comparison circuit that compares the first parallel data with the second parallel data and outputs a comparison result when the selector outputs the serial data signal from the first transmission line, wherein the comparison result indicates whether an abnormality has occurred in any of the first data receiving circuit, the second data receiving circuit, the first serial-parallel conversion circuit, and the second serial-parallel conversion circuit of the source driver.

5. The display device according to claim 4, wherein the timing controller receives a comparison result of the comparison circuit from the source driver, and detects whether or not an abnormality has occurred in any of the first data receiving circuit, the second data receiving circuit, the first serial-parallel conversion circuit, and the second serial-parallel conversion circuit of the source driver based on the comparison result.

* * * * *